US006568457B2

(12) United States Patent
Uike

(10) Patent No.: US 6,568,457 B2
(45) Date of Patent: May 27, 2003

(54) VIBRATING APPARATUS FOR COMPACTING MOLDING SAND

(75) Inventor: Minoru Uike, Nagasaki (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 09/901,422

(22) Filed: Jul. 3, 2001

(65) Prior Publication Data

US 2002/0020512 A1 Feb. 21, 2002

(30) Foreign Application Priority Data

Jul. 5, 2000 (JP) ..... 2000-203821

(51) Int. Cl.[7] ..... B22C 15/10
(52) U.S. Cl. ..... 164/203; 164/205
(58) Field of Search ..... 164/203, 205, 164/39

(56) References Cited

U.S. PATENT DOCUMENTS 5,355,732 A * 10/1994 Andderl et al. ..... 73/672
5,606,231 A * 2/1997 Kroger et al. ..... 318/67
6,213,630 B1 * 4/2001 Kossmann ..... 366/128

FOREIGN PATENT DOCUMENTS

JP 10-328783 * 12/1998

* cited by examiner

*Primary Examiner*—Tom Dunn
*Assistant Examiner*—I.-H. Lin
(74) *Attorney, Agent, or Firm*—Finnegan, Henderson, Farabow, Garrett & Dunner LLP

(57) ABSTRACT

A vibrating apparatus for vibrating a flask to compact molding sand in the flask, including an elastically supported vibrating table on which a flask is placed and two unbalanced-weight-type motors mounted on the vibrating table at the sides of the flask for vibrating it by rotating the unbalanced weights of the motors. The axes of rotation of both motors are located on a horizontal line that substantially passes the centroid of the entire elastically supported vibrating apparatus, including the vibrating table, the two motors, the flask, and the molding sand in the flask. Further, both unbalanced weights of the motors are rotated at a speed in one direction.

6 Claims, 5 Drawing Sheets

VIBRATING APPARATUS FOR COMPACTING MOLDING SAND

BACKGROUND OF THE INVENTION

1. Field of the Invention

This invention relates to a vibrating apparatus for vibrating a flask to compact molding sand in the flask, and in more detail, to an improvement of a vibrating apparatus for vibrating a flask to compact molding sand in the flask that is provided with an elastically supported vibrating table on which the flask is mounted and with unbalanced-weight-type vibrating motors mounted on the vibrating table for vibrating it by rotating the unbalanced weights of the motors.

2. Description of the Prior Art

In conventional evaporative pattern casting, which uses molding sand that includes no binder, or in conventional molding for producing a self-hardening mold, which uses molding sand that includes a small amount of binders, a vibrating table is used for vibrating a flask to satisfactorily and efficiently compact molding sand in the flask.

Such a vibrating table must cause the molding sand to move circularly to satisfactorily and efficiently compact it when the flask is vibrated. A vibrating device for circularly moving the molding sand to compact it is proposed in JP 10-328783, A. The vibrating device as shown in the Japanese patent gazette includes two unbalanced-weight-type motors mounted on a vibrating table at the sides of a flask placed on the vibrating table, with the axes of rotation of the motors being arranged in parallel at the level of the centroid of the flask.

However, in the conventional vibrating device for compacting molding sand, which is configured as described above, in fact the two unbalanced weights rotate out of phase, resulting in a phase difference between them. The phase difference causes a problem in that the vibrating table cannot move in a required circular motion since it oscillates laterally.

This invention has been conceived to overcome that problem. Its purpose is to provide a vibrating apparatus for compacting molding sand that can eliminate the oscillation of the vibrating table.

SUMMARY OF THE INVENTION

The vibrating apparatus of the present invention for vibrating a flask to compact molding sand in it included an elastically supported vibrating table on which the flask can be placed, and two unbalanced-weight-type motors mounted on the vibrating table for vibrating it by rotating the unbalanced weights of the motors. The two motors are disposed above the vibrating table at the sides of the flask. The axes of rotation of the motors are located on a horizontal line that substantially passes the centroid of the entire elastically supported vibrating apparatus, including the vibrating table, the two motors, the flask, mad molding sand in the flask. Further, the unbalanced weights of the motors are rotated at the same speed in one direction.

If there is a phase difference between the unbalanced weights when they are rotated at the same speed in one direction by the two motors, the rotation moment of the two unbalanced weights is less than that when there is no phase difference, as shown in FIG. 1. In FIG. 1, F denotes the centrifugal force of one unbalanced weight, and L denotes the radius of rotation of both weights. FIG. 2 shows the rotation moment of the unbalanced weights when the phase difference varies between them. If the common axis of rotation of the motors does not coincide with the centroid of the entire vibrating apparatus, the apparatus would oscillate laterally. However, in the vibrating apparatus of the present invention the length of the arm of the rotation moment that accounts for the lateral oscillation is zero. Therefore, the rotation moment that accounts for the lateral oscillation will also be zero.

In one aspect of the invention, the vibrating apparatus includes means for adjusting the vertical position of the two motors to have their axes of rotation coincide with the centroid of the entire vibrating apparatus when the position of the centroid changes.

DESCRIPTION OF THE PREFERRED EMBODIMENTS

Some preferred embodiments of the invention are now explained by reference to FIGS. 3–6. The same reference numbers denote the same or similar elements.

Figure 1:
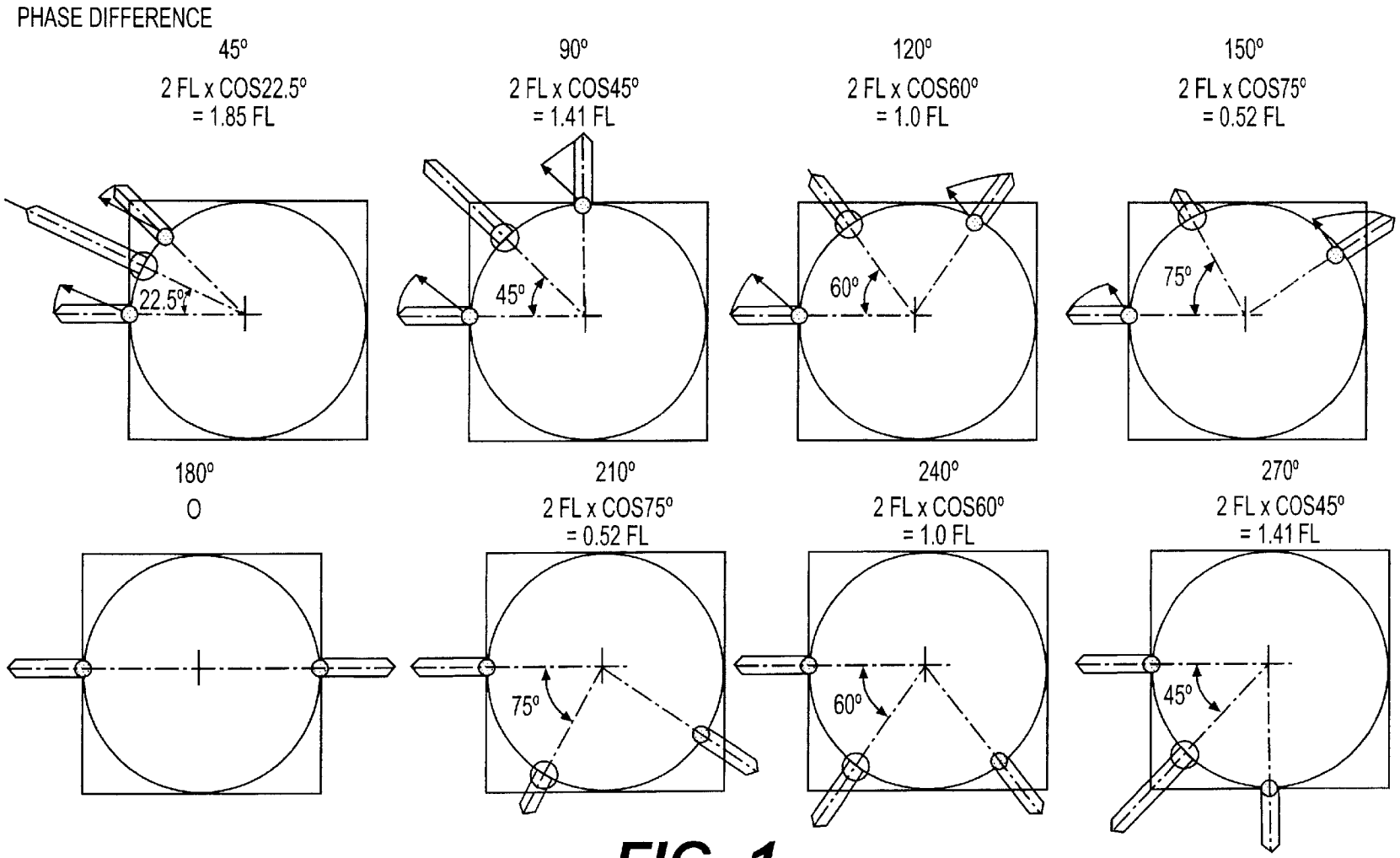
FIG. 1 shows the rotation moment of two unbalanced weights when they are rotated at the same speed in one direction where they have a phase difference of 45°, 90°, 120°, 150°, 180°, 210°, 240°, or 270°.
Figure 2:
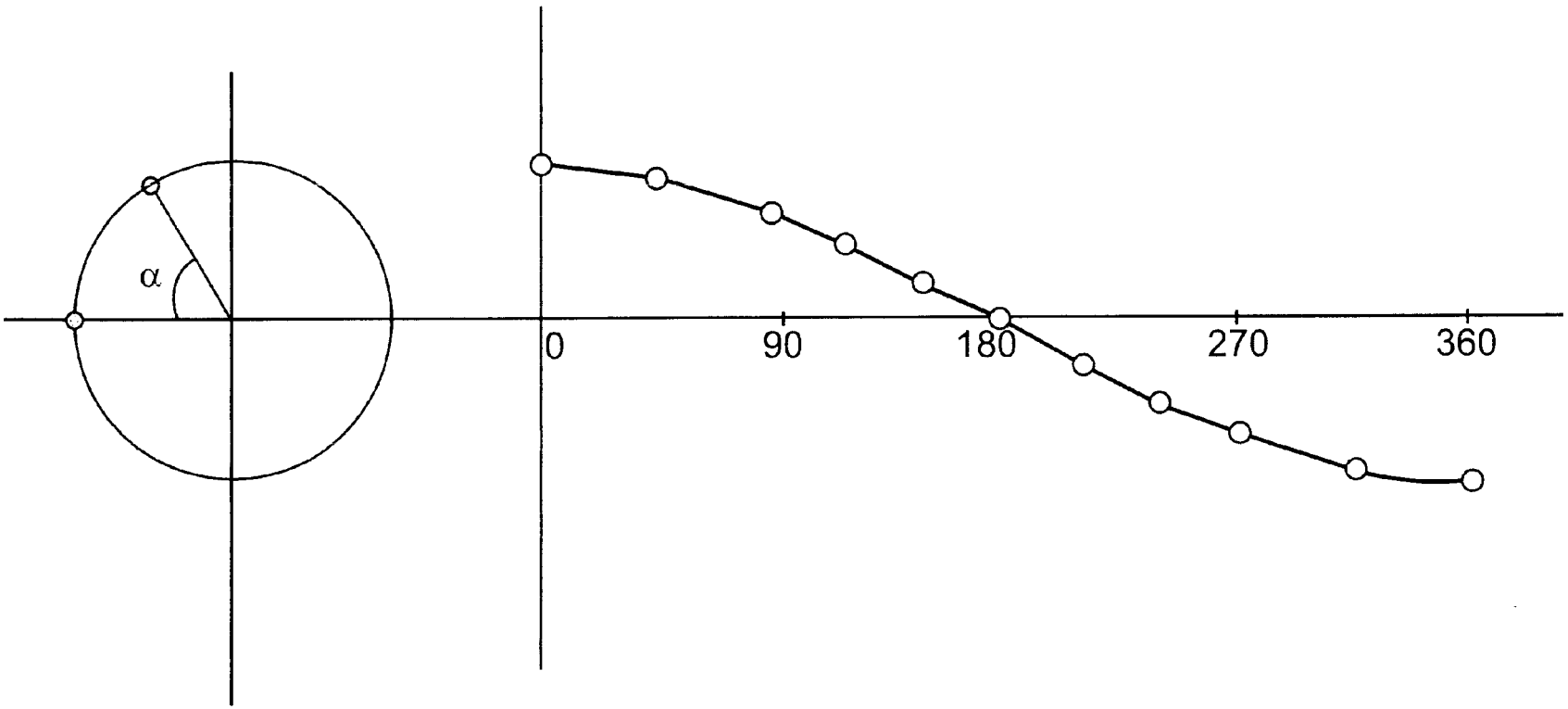
FIG. 2 is a graph showing the rotation moment of the unbalanced weights when their phase difference varies.
Figure 3:
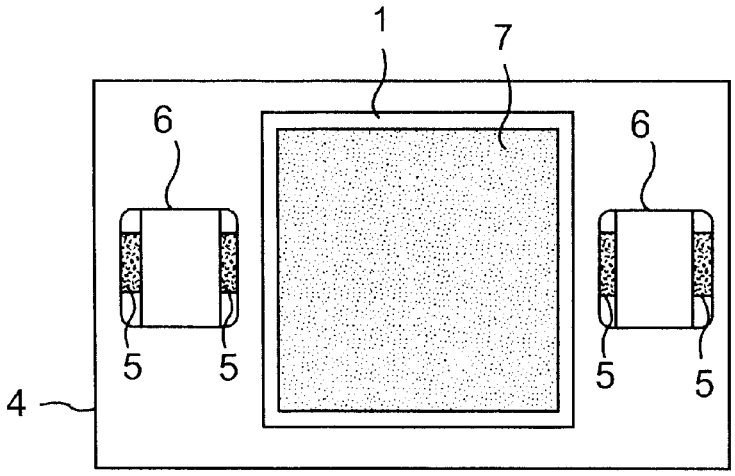
FIG. 3 is a plan view of an embodiment of the vibrating apparatus of the invention.
Figure 4:
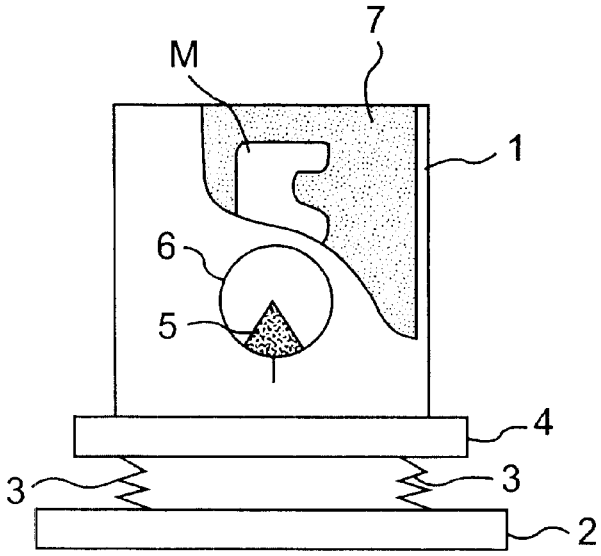
FIG. 4 is a side view, partly in section, of the vibrating apparatus of FIG. 3.

The first embodiment of the vibrating apparatus for compacting molding sand is shown in FIGS. 3 and 4. The apparatus includes a vibrating table 4 elastically supported on a machine base 2 by means of coil springs 3, 3 for carrying a flask 1 thereon. The apparatus also includes two unbalanced-weight-type vibrating motors 6, 6 mounted on the vibrating table 4 for vibrating it by rotating a pair of unbalanced weights 5, 5 of the motors.

The two motors 6, 6 are disposed above the vibrating table 4 at the sides of the flask 1, with their axes of rotation being on a line. Further, those axes substantially pass the centroid of the entire vibrating apparatus that is elastically mounted by means of the coil springs 3, 3, including the vibrating table 4, the two vibrating motors 6, 6, the flask 1, the molding sand in the flask 1, and an evaporative pattern M located in the flask. Further, the motors 6, 6 rotate the unbalanced weights at the same speed in one direction.

When the apparatus is operating, if the unbalanced weights 5, 5 have a phase difference when rotated at the same speed in one direction by means of the vibrating motors 6, 6, the rotational motion of the two unbalanced weights is less than that when no phase difference occurs between them, as described above. This rotation moment may cause the vibrating apparatus to oscillate laterally. However, since in the apparatus of the invention the axes of rotation of the motors 6, 6 substantially pass the centroid of the entire vibrating apparatus, the length of the arm of the rotation moment that accounts for the lateral oscillation is zero. Thus no oscillation is caused.

Further, in an actual evaporative pattern molding, first, floor sand is compacted by linear vibrations. Then, after a pattern is set in a flask, molding sand is moved circularly. The direction of the circular motion of the molding sand may be changed during its compaction, depending on the direction that a hole of a pattern faces. When the direction of the circular motion must be changed, just changing the direction of the rotation of the motors does so.

Figure 5A:
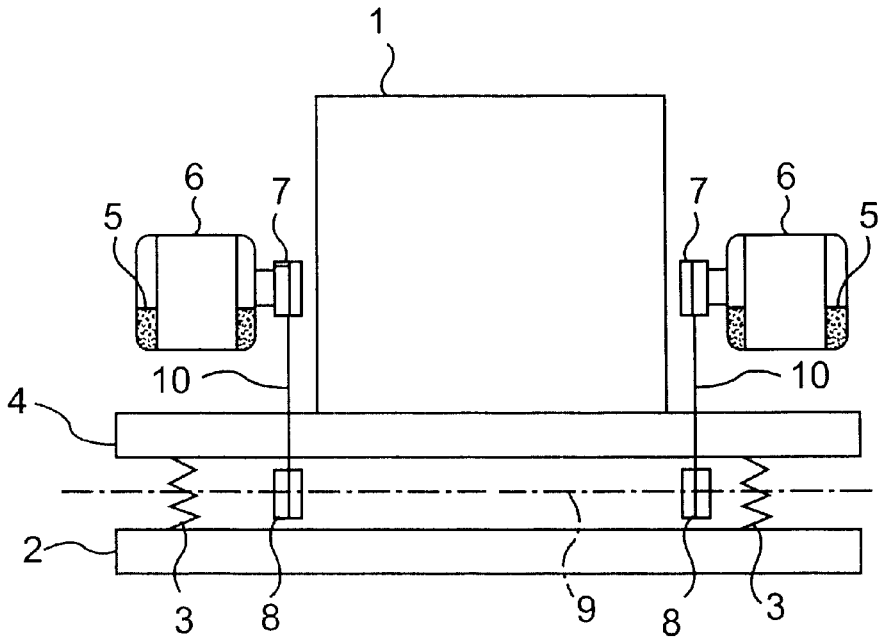
FIG. 5A is a side view of another embodiment of the vibrating apparatus of the invention.

FIG. 5A shows a second embodiment. If the apparatus of the first embodiment is large, the motors 6, 6 cannot rotate at the same speed. To overcome this problem, the motors 6, 6 are improved, as shown in FIG. 5A. Each motor 6 has a toothed pulley 7 at one end of its output shaft. A rotary shaft 9 that has a toothed pulley 8 at each of its ends is disposed under the vibrating table 4. The toothed pulleys 7, 7 of the motors 6, 6 are connected to the toothed pulleys 8, 8 of the rotary shaft 9 by means of timing belts 10, 10 to rotate the motors 6, 6 at the same speed in one direction. In this embodiment the machine base 2, coil springs 3, 3, vibrating table 4, and unbalanced weights 5, 5 that are used in the first embodiment are also used.

Figure 5B:
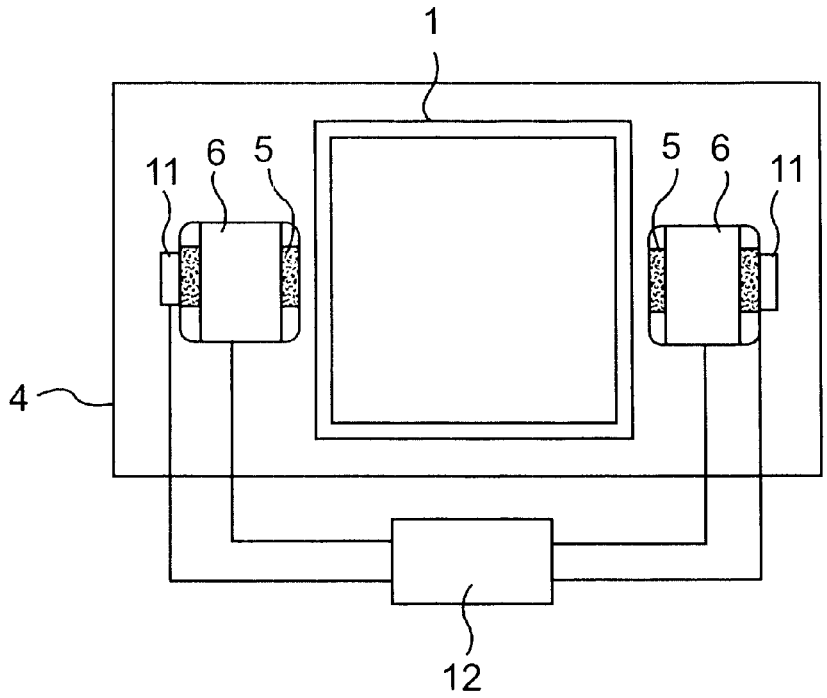
FIG. 5B is a plan view of another embodiment of the vibrating apparatus of the invention.

FIG. 5B shows another embodiment to rotate the motors 6, 6 at the same speed in one direction. Instead of the rotary shaft 9 coupled to the motors 6, 6 as in FIG. 5A, a sensor 11 may be attached to one end of the output shaft of each motor 6 for detecting the phase difference between the two unbalanced weights. A phase controller 12 receives a signal representative of any phase difference from the sensors 11, 11 attached to the output shafts of the motors and sends a synchronizing signal to the motors so that they can rotate at the same speed in one direction.

Figure 6A:
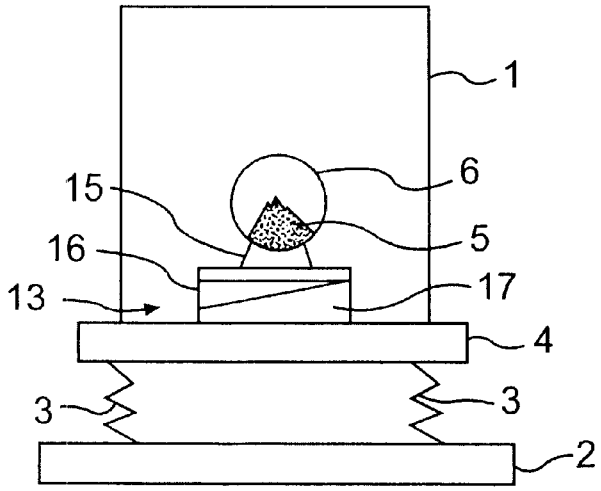
FIG. 6A is a side view of another embodiment of the vibrating apparatus of the invention, which has a mechanism for adjusting the vertical position of two motors.
Figure 6B:
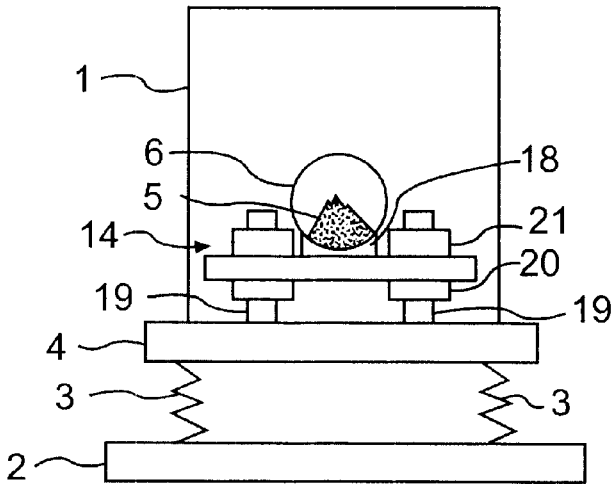
FIG. 6B is a side view of another embodiment of the vibrating apparatus of the invention, which has a mechanism for adjusting the vertical position of the two motors.

FIGS. 6A and 6B show the other embodiments, wherein a mechanism 13 or 14 is mounted on the vibrating table 4 at each of the sides of flask 1 to adjust the vertical location of the motors 6, 6. When, for example, the flask 1 is changed, the centroid of the entire vibrating apparatus may change. In that case, the position of the axes of rotation of the motors 6, 6 must be changed so that it coincides with the centroid of the entire vibrating apparatus, to eliminate the lateral oscillation.

In FIG. 6A the mechanism 13 carries the motor 6 through a lifter table 15. The mechanism 13 includes a set of mated wedges 16, 17. When one of the wedges, i.e., 16 or 17, slides horizontally, the level of the motor is changed, i.e., the motor is moved to an upper or lower position.

In FIG. 6B the mechanism 14 carries the motor 6 through a lifter table 18. The mechanism 14 includes threaded studs 19, 19 and nuts 20, 21 threaded on them. When the nuts 20, 21 are moved upward or downward, the motor 6 is moved upward or downward.

Although the first embodiment describes compacting molding sand in an evaporative pattern casting, this invention can be also used to mold self-hardening sand, wherein the same operation is carried out, and the same results can be obtained, as for the evaporative pattern casting.

For one skilled in the art, clearly some variations or modifications can be made to the embodiments described above. The scope of the invention includes such variations and modifications and is set forth in the attached claims.

What I claim is:

1. A vibrating apparatus for vibrating a flask to compact molding sand in the flask, comprising:

an elastically supported vibrating table on which a flask is placed; and two unbalanced-weight driving motors mounted on the vibrating table, one on each of opposite sides of the flask, for vibrating the vibrating table by rotating an unbalanced weight of each motor, the motors and unbalanced weights having a common horizontal axis of rotation that passes substantially through a centroid of the entire elastically supported vibrating apparatus, including the vibrating table, the two motors, the flask, and the molding sand in the flask, the unbalanced weights of the motors being rotatable at a common speed and in a common direction.

2. The apparatus of claim 1, wherein output shafts of the two motors are connected to each other through transmission means such that the output shafts rotate at the common speed and in the common direction.

3. The apparatus of claim 2, further comprising means for adjusting a vertical location of the motors.

4. The apparatus of claim 1, further comprising means for adjusting a vertical location of the motors.

5. The apparatus of claim 1, further comprising a controller for controlling a phase difference between the unbalanced weights such that the output shafts rotate at the common speed and in the common direction.

6. The apparatus of claim 5, further comprising means for adjusting a vertical location of the motors.

* * * * *